US009279307B2

(12) United States Patent
Williamson

(10) Patent No.: US 9,279,307 B2
(45) Date of Patent: Mar. 8, 2016

(54) RETRIEVABLE BRIDGE PLUG

(71) Applicant: Weatherford/Lamb, Inc., Houston, TX (US)

(72) Inventor: Scott Williamson, Castle Rock, CO (US)

(73) Assignee: Weatherford Technology Holdings, LLC, Houston, TX (US)

( * ) Notice: Subject to any disclaimer, the term of this patent is extended or adjusted under 35 U.S.C. 154(b) by 242 days.

(21) Appl. No.: 13/953,440

(22) Filed: Jul. 29, 2013

(65) Prior Publication Data

US 2013/0306327 A1 Nov. 21, 2013

Related U.S. Application Data

(62) Division of application No. 12/539,517, filed on Aug. 11, 2009, now Pat. No. 8,505,623.

(51) Int. Cl.
*E21B 33/134* (2006.01)
*E21B 33/129* (2006.01)

(52) U.S. Cl.
CPC ..... *E21B 33/134* (2013.01); *E21B 33/1294* (2013.01)

(58) Field of Classification Search
CPC .... E21B 33/1294; E21B 33/134; E21B 23/06
See application file for complete search history.

(56) References Cited

U.S. PATENT DOCUMENTS 3,306,366 A 2/1967 Muse
3,356,140 A 12/1967 Young
3,434,538 A * 3/1969 Pumpelly et al. ..... 166/123
3,457,994 A 7/1969 Stachowiak
3,460,626 A 8/1969 Ehrlich
3,556,220 A 1/1971 Schwegman
3,831,677 A 8/1974 Mullins
4,078,606 A * 3/1978 Montgomery ..... 166/120
4,149,594 A * 4/1979 Evans ..... 166/134
4,274,489 A 6/1981 Harris
4,349,071 A 9/1982 Fish
4,436,150 A * 3/1984 Barker ..... 166/131
4,646,829 A * 3/1987 Barrington et al. ..... 166/125
4,648,445 A 3/1987 Caskey
4,693,309 A 9/1987 Caskey (Continued)

OTHER PUBLICATIONS

TechWest Inc., Data Sheet entitled "WR Bridge Plug," undated.

(Continued)

*Primary Examiner* — Robert E Fuller
(74) *Attorney, Agent, or Firm* — Blank Rome, LLP

(57) ABSTRACT

A bridge plug can be deployed downhole and retrieved using a retrieval tool disposed on jointed or coiled tubing or on another bridge plug. Internally, the bridge plug has a sleeve that is movable on a stem of the plug's tailpiece. When in a first position, the sleeve prevents fluid communication through ports in the stem so that circulated fluid from the retrieval tool can be used to clear debris from the plug during retrieval. When the retrieval tool engages the sleeve in the plug, pulling up on the tool moves the sleeve to an intermediate position in which fluid pressure is equalized across the plug. Further pulling up on the tool locks the sleeve in a further position on the stem so that circulated fluid from the retrieval tool will pass directly to the stem's ports. Movement of the sleeve by the retrieval tool also releases the engaged slips and packing element on the bridge plug's mandrel.

37 Claims, 6 Drawing Sheets

(56) References Cited

U.S. PATENT DOCUMENTS

| | | | |
|---|---|---|---|
| 4,880,058 | A | 11/1989 | Lindsey et al. |
| 4,898,239 | A | 2/1990 | Rosenthal |
| 5,048,613 | A | 9/1991 | Shilling |
| 5,074,361 | A | 12/1991 | Brisco et al. |
| 5,178,219 | A | 1/1993 | Striech et al. |
| 5,197,547 | A | 3/1993 | Morgan |
| 5,727,632 | A | 3/1998 | Richards |
| 5,813,456 | A | 9/1998 | Milner et al. |
| 5,826,652 | A | 10/1998 | Tapp |
| 6,167,970 | B1 | 1/2001 | Stout et al. |
| 6,220,348 | B1 | 4/2001 | Serafin |
| 6,244,642 | B1 | 6/2001 | Serafin |
| 6,513,590 | B2 | 2/2003 | Allamon et al. |
| 6,516,886 | B2 | 2/2003 | Patel |
| 6,564,876 | B2 | 5/2003 | Vaynshteyn et al. |
| 6,926,088 | B2 | 8/2005 | Tinker |
| 6,942,039 | B2 | 9/2005 | Tinker |
| 2003/0024712 | A1 | 2/2003 | Neal et al. |
| 2003/0183391 | A1 | 10/2003 | Hriscu et al. |
| 2008/0308282 | A1 | 12/2008 | Standridge et al. |
| 2008/0314583 | A1 | 12/2008 | Xu |

OTHER PUBLICATIONS

RT Manufacturing LLC, "Model C Retrievable Bridge Plug," Data Sheet, undated.

Sii Smith Services, "Bridge Plug—MC-II Retrievable Bridge Plug," obtained from www.siismithservices.com, generated Jun. 3, 2009.

Halliburton, "HE3®/HX4 Retrievable Bridge Plug," obtained from www.halliburton.com, generated Jun. 3, 2009.

Team Oil Tools, Inc., "The T725 TS-U Retrievable Bridge Plug," obtained from www.teamoiltools.com, copyright 2001.

Team Oil Tools, Inc., "The T727 TSW Bridge Plug (Tubing and Wireline Set Capable)," obtained from www.teamoiltools.com, copyright 2001.

Weatherford, "Petroline Slickplug, Slickline-Set Retrievable Bridge Plug," Brochure 226.02, copyright 2005-2007.

Weatherford, "WRP Bridge Plug," Brochure 2929.00, copyright 2006.

Select Energy Systems Inc., "WR Bridge Plug," Data Sheet, copyright 2008.

Complete Oil Tools, Inc., "WRP Retrievable Bridge Plug," obtained from www.completeoiltools.com, generated May 21, 2009.

* cited by examiner

RETRIEVABLE BRIDGE PLUG

CROSS-REFERENCE TO RELATED APPLICATIONS

This is a divisional of application Ser. No. 12/539,517, filed 11-Aug.-2009, to which priority is claimed and which is incorporated herein by reference in its entirety.

BACKGROUND

A bridge plug can be set downhole to isolate portions of a wellbore. Some bridge plugs are retrievable from the wellbore, while others are intended to be permanently set. Retrievable bridge plugs can be set downhole using wireline, slickline, or coiled tubing and can temporarily isolate portions of the wellbore for a treatment operation or the like. Once the operation is completed, the bridge plugs can be retrieved.

As shown in FIG. 1A, a typical retrievable bridge plug 20 according to the prior art has a mandrel 22 with a wireline coupling 24, slips 26, and packing element 28. This bridge plug 20 is a Wireline Retrievable Bridge Plug (WRP bridge plug) available from Weatherford—the assignee of the present disclosure. For deployment, operators use wireline, slickline or coiled tubing (not shown) connected by a wireline or hydraulic setting tool (not shown) to the coupling 24 and deploy the bridge plug 20 to a desired point in the borehole casing (not shown). At the desired point, the plug 20 is set using the wireline or hydraulic setting tool (not shown). As the plug 20 is set, its slips 26 engage the casing, and its packing element 28 engages the casing to isolate the annulus above and below the plug 20. In general, a central portion 24*a* of the coupling 24 is manipulated relative to an external portion 24*b* so that the inner mandrel 22 moves relative to an outer sleeve 23 to compress the packing elements 28 between gage rings 29*a-b* and to push the slips 26 outward between wedge members (not labeled).

For retrieval, a pulling tool (not shown) is run on a tubing string downhole to the setting depth. Fluid is circulated to clear the plug 20 of debris. Once clear, the pulling tool is set down to the coupling 24 with a predetermined amount of load to shift an equalizing sleeve 25 on the plug 20. With the sleeve 25 shifted, differential pressure above and below the plug 20 equalizes so downhole pressure below the plug 20 will not force it uphole until the slips 26 and packing elements 28 are released. After equalizing the pressure differential, a predetermined amount of tension is applied by the pulling tool on the plug 20 to release the slips 26 and packing elements 28.

When used during operations, several of these retrievable bridge plugs 20 can be run in the wellbore and stacked one above another to temporarily isolate and treat multiple zones of the wellbore. When this is done, it is difficult to retrieve more than one of the bridge plugs 20 on a single run with tubing. Unfortunately, fluid cannot be circulated past the topmost bridge plug 20 to wash sand and other debris off the bridge plugs 20 disposed downhole from it in the wellbore. Without the ability to circulate fluid, it is not possible to clean debris from the lower bridge plugs 20, latch onto them, and release them in a single run. In addition, this conventional wireline-set retrievable bridge plug 20 has a tendency of resetting after being released. This resetting prevents subsequent downwards movement of the bridge plug 20, making it difficult to retrieve an uppermost plug 20 and then move it downhole without resetting before releasing a lower plug 20.

Because of the tendency of the retrievable plugs 20 to reset and the inability to circulate fluid to clear debris, operators must perform multiple trips or runs with a tubing string to retrieve all the bridge plugs 20 in the wellbore. For example, operators must circulate fluid at the topmost plug 20 to wash away debris so tubing can be coupled to the plug 20. Then, this plug 20 must be removed from the wellbore entirely so that a new run can be made to clear debris from the next lower bridge plug 20 to run it out of the wellbore. As expected, such operations can be time consuming and expensive and can expose the formation to excessive fluid losses.

To overcome the limitations of the typical retrievable bridge plug 20, Weatherford has developed another bridge plug according to the prior art for tandem retrieval. As shown in FIG. 1B, this retrievable bridge plug 30 is a modified version of the WRP bridge plug described above and has similar components. In particular, the plug 30 includes a mandrel 32, slips 36, and packing element 38 as before. Likewise, the plug 30 is set in much the same manner as before. For example, the plug 30 is run downhole, and a setting tool (not shown) coupled to the coupling 34 manipulates the central portion 34*a* relative to the outer portion 34*b* so that an inner mandrel 32 shifts relative to an outer sleeve 33 and causes the slips 36 to set and the packing element 38 to be compressed between gage rings 39*a-b*.

In contrast to the previous arrangement, however, this bridge plug 30 incorporates a releasing mechanism intended to keep the plug 30 in a locked position after release. As shown, the plug 30 includes a lower extension 45 coupled to the inner mandrel 32 and extending down from the plug 30. When the mandrel 32 is shifted (uphole) during retrieval procedures of the plug 30, the extension 45 is moved up further into the plug 30, and a wedge and ring arrangement 37 on the plug 30 engages a widened and serrated portion of the extension 45 to help lock the plug 30 once released.

As also shown in FIG. 1B, a retrieval head 40 attached to a tubing string or other plug (not shown) couples to the coupling 34 at the top of the plug 30 for retrieval. The retrieval head 40 is used to equalize, release, and retrieve the plug 30 during operation. Moreover, the extension 45 has a retrieval head 40 coupled to its distal end allowing the depicted plug 30 to retrieve a lower plug in tandem. The retrieval head 40 has a collet 42 that can catch the outer portion 34*b* of the coupling 34 and has an outer sleeve 44 that can open the equalizing sleeve 35 at the top of the plug 30.

As noted above, the plug 30's releasing mechanism helps keep the plug 30 in a locked position after release. Combined with the extension 45 and retrieval head 40, the plug 30 has been used in operations where several such plugs 30 have been retrieved in tandem. However, the plug 30 still fails to adequately address circulating fluid down to the next plug to clear it of debris for tandem retrieval. Although fluid may find its way past the plug 30 during retrieval operations so that fluid can clear some debris away from the lower plug 30, a great deal of fluid may be lost in the process. Therefore, more fluid is lost to the formation during retrieval. Moreover, additional amounts of fluid are required to clear debris from even lower plugs and can result in undesirable loss of fluid to the formation.

The subject matter of the present disclosure is directed to overcoming, or at least reducing the effects of, one or more of the problems set forth above.

SUMMARY

A bridge plug has a mandrel, a tailpiece, and a setting sleeve. To set the plug and isolate a casing's annulus, the plug has an engagement assembly disposed on the mandrel that is engageable with the surrounding casing wall when activated.

For example, the engagement assembly includes a packing element disposed on the mandrel that is compressible to engage the surrounding wall. In addition, the engagement assembly includes a slip disposed on the mandrel that is movable outward from the plug to engage the surrounding wall. Gage rings sandwich the packing element, and wedge or cone members sandwich the slips. To set the plug and isolate a casing's annulus, manipulation of the mandrel relative to the setting sleeve on the plug compresses the packing element between the gage rings and forces the slip outward from the plug to engage with the surrounding casing.

Disposed in the internal passage of the mandrel, a valve assembly can be moved on a stem of the tailpiece. For example, the valve assembly can include an internal releasing sleeve movably disposed on the tailpiece's stem. In a first position, the releasing sleeve covers a port in the tailpiece and prevents fluid from flowing from the mandrel's internal passage and the port. In a second position, the releasing sleeve moves on the tailpiece away from the port to allow fluid to communicate from the releasing sleeve to the port.

When the releasing sleeve is moved to the second position, it also releases the slip and the packing element to release the plug from the casing. To prevent the plug from resetting, a snap ring on the mandrel can engage the internal sleeve when it reaches the second position. The releasing sleeve can also be moved to an intermediate position before the second position to first allow fluid to communicate between the internal passage and the port and to equalize fluid pressure on both sides of the packing element.

The releasing sleeve preferably has a shoulder disposed thereabout, and the internal passage of the mandrel preferably has a ledge disposed thereabout. When the sleeve is in the first position, the shoulder aligns with the ledge and prevents debris (e.g., sand) from collecting in the lower portion of the plug.

To clear the plug of debris and retrieve it from the wellbore, operators run a string (e.g., coiled or jointed tubing) downhole in the wellbore and circulate fluid from a retrieval tool on the end of the string. This circulated fluid removes debris from the bridge plug set downhole. Operators then set down the retrieval tool inside the internal sleeve of the bridge plug and catch a collet on the tool to an internal groove in the releasing sleeve.

Pulling up on the retrieval tool to a first position, operators equalize pressure in the wellbore on both sides of the first bridge plug. In particular, operators pull up on the retrieval tool to an intermediate position to move the internal sleeve relative to the port. Once equalized, operators stop circulating fluid and release the bridge plug from the wellbore by pulling up further on the internal sleeve until the plug has reached an extended and released condition. In this condition, the fluid from the retrieval tool passes directly through the internal sleeve in the plug to the port in the tailpiece. Subsequently, the released bridge plug can be moved downhole with the string, and another retrieval tool coupled to the end of this plug can be used to remove debris and release another bridge plug further downhole.

The foregoing summary is not intended to summarize each potential embodiment or every aspect of the present disclosure.

DETAILED DESCRIPTION

Figure 1A:
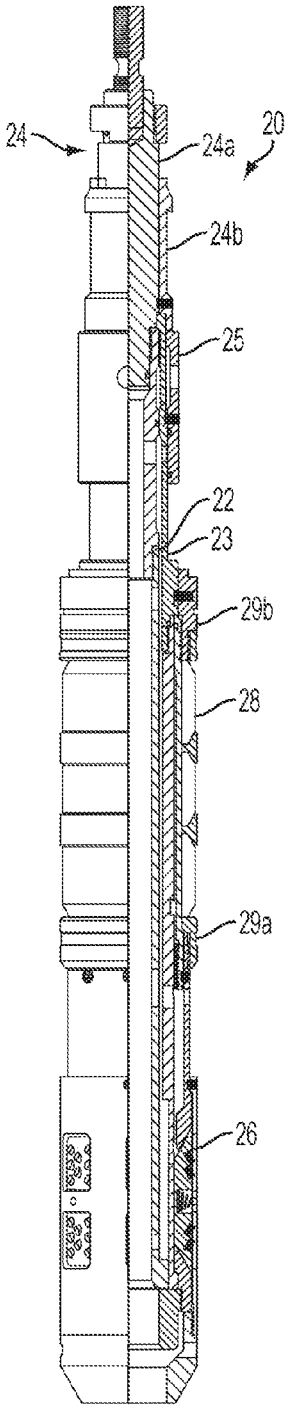
FIG. 1A PRIOR ART
FIG. 1A shows a partial cross-section of a bridge plug according to the prior art.
Figure 1B:
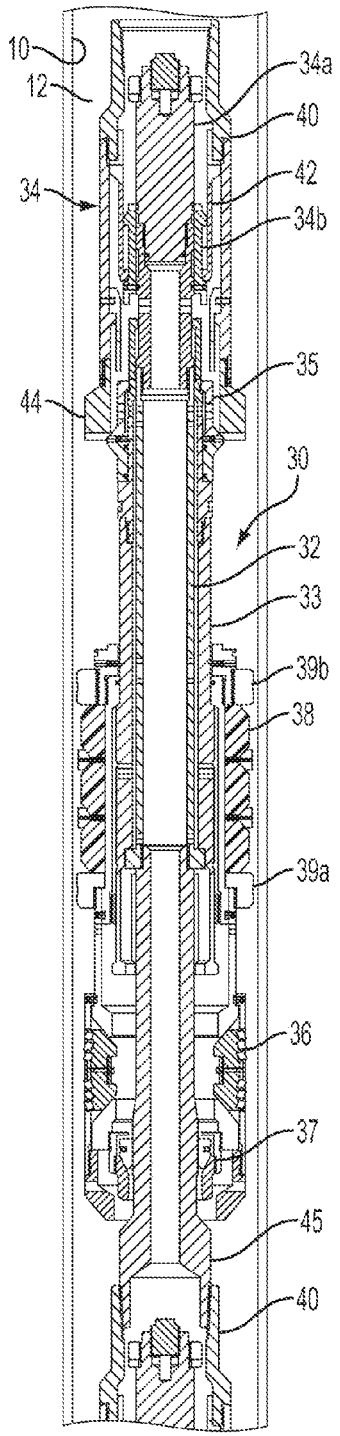
FIG. 1B PRIOR ART
FIG. 1B shows a cross-section of another bridge plug according to the prior art for tandem retrieval.
Figure 2A:
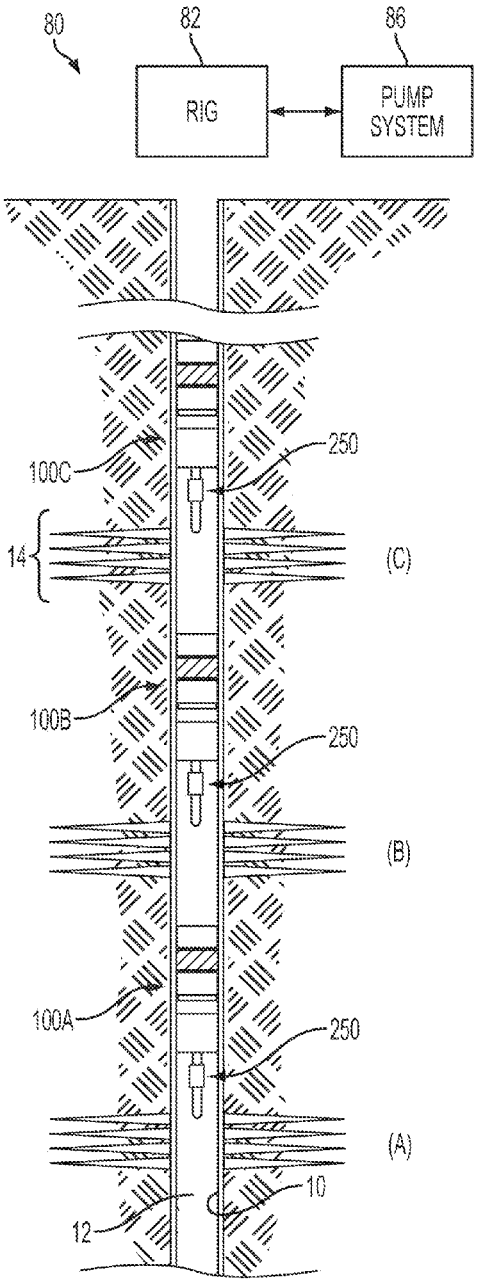
FIG. 2A diagrammatically illustrates a borehole having multiple bridge plugs according to the present disclosure deployed therein.

As diagrammatically illustrated in FIG. 2A, a wellbore casing 10 has multiple retrievable bridge plugs 100A-C deployed therein. These retrievable bridge plugs 100A-C can be used for various operations, such as acidizing, fracturing, cementing, casing pressure tests, wellhead replacement, and zonal isolation. For example, the plugs 100A-C in FIG. 2A have been run downhole to isolate the wellbore into multiple isolated zones for a frac operation. In such an operation, operators at the rig 82 perforate the casing 10 at a lower zone (A) and pump frac fluid into the casing 10 using a pump system 86. The frac fluid typical includes a proppant such as sand. The pumped frac fluid produces fractures in the formation at the casing's perforations, and the proppant acts to hold the fractures open.

When this lower zone (A) has been fraced, operators run a bridge plug 100A downhole to isolate the fraced zone (A) from upper zones of the formation. For example, the plug 100A can be set using wireline or tubing and a hydraulic setting tool. After setting the plug 100A, operators perforate the casing at a next higher zone (B), pump frac fluid downhole, and isolate the zone (B) with another bridge plug 100B. Continuing in this manner, operators move up the wellbore to treat multiple isolated zones (A-C). In some instances, three or more zones may be treated in this manner.

When the frac operation is complete, the multiple bridge plugs 100A-C remain set in the wellbore casing 10 as shown in FIG. 2A. To continue with operations and production, the multiple bridge plugs 100A-C must be retrieved from the wellbore. Rather than requiring multiple runs and loss of fluid to retrieve them, the bridge plugs 100A-C of the present disclosure can be retrieved in tandem using one run with a retrieving string (not shown) using coil or jointed tubing.

Figure 2B:
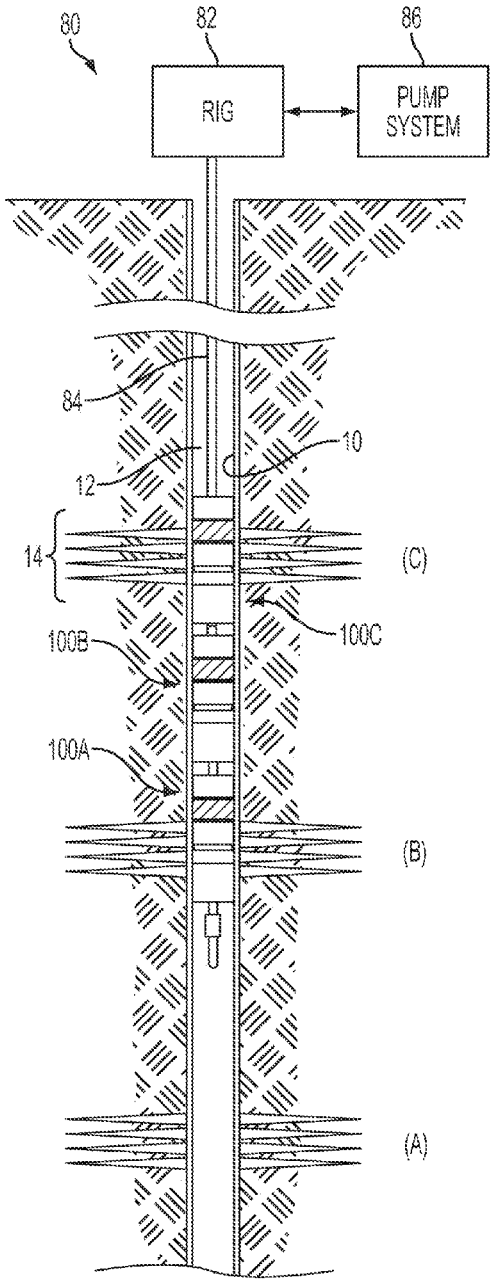
FIG. 2B diagrammatically illustrates the borehole having the multiple bridge plugs being retrieved in one run with tubing.

As diagrammatically shown in FIG. 2B, for example, operators deploy a retrieving string 84 downhole from the rig 82 to the uppermost bridge plug 100C. Operators circulate fluid with the pump system 86 and clear away any debris (e.g., sand) from the uppermost bridge plug 100C so the a retrieval tool 250 can properly couple and release this uppermost plug 100C.

Using procedures detailed later, the retrieval tool 250 equalizes and releases the bridge plug 100C. Now in its released state, the bridge plug 100C avoids resetting against the casing as the plug 100C is manipulated downhole toward the next lowermost bridge plug 100B. Near this next bridge plug 100B, circulated fluid down the string 84 passes through the upper bridge plug 100C and its retrieval tool 250 to clear debris from this next lowermost bridge plug 100B. Then, the retrieval tool 250 is inserted into the lower bridge plug 100B to retrieve it and also circulate fluid through it. These steps are repeated to retrieve other bridge plugs (i.e., 100A) lower downhole.

As seen above, the bridge plugs 100 and retrieval tools 250 allow operators to circulate fluid to clean the inside of lower plugs 100 of debris and to continue to circulate the fluid until the lower plug 100 is released. At the end of the retrieval operation, the various plugs 100A-C can be pulled in tandem from the wellbore to the surface. Advantageously, any number of temporary bridge plugs 100 can be retrieved from downhole in one run with coiled or jointed tubing. Although several plugs 100 have been described as being used at the same time in a well, running just one such plug 100 can be beneficial for some implementations. For example, one plug 100 deployed in the well can be used to clean out to the bottom of the well after release.

Figure 3A:
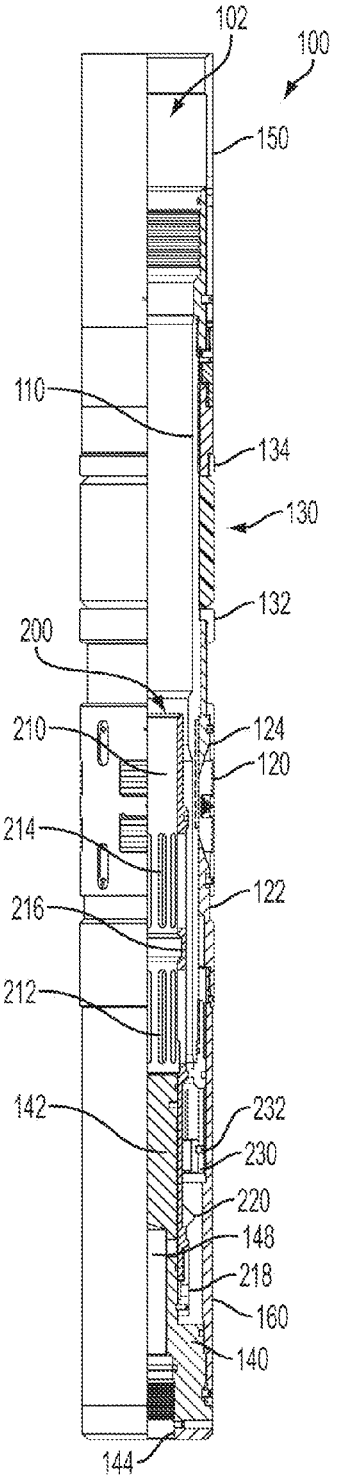
FIG. 3A shows a partial cross-section of a bridge plug according to the present disclosure.
Figure 3B:
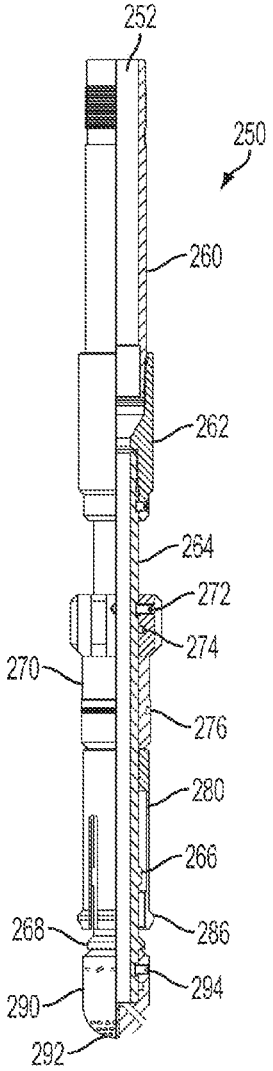
FIG. 3B shows a partial cross-section of a retrieval tool attachable to the tailpiece of the bridge plug of FIG. 3A.

With this general understanding of the disclosed bridge plug 100 and its operation, discussion now turns to FIGS. 3A-3B showing the bridge plug 100 (FIG. 3A) and the retrieval tool 250 (FIG. 3B) in more detail. A mandrel 110 of the bridge plug 100 has a tailpiece 140 disposed at its downhole end and has a setting sleeve 150 disposed at its uphole end. Disposed between these two ends, the mandrel 110 has an engagement assembly disposed thereon that is used to set the plug and isolate a casing's annulus. As shown, the engagement assembly includes slips 120 and one or more packing elements 130. The slips 120 are sandwiched between lower and upper cones 122/124 and are movable outward from the plug 100 to engage the surrounding wall of a casing when set. The one or more packing elements 130 are sandwiched between lower and upper gage rings 132/134 and are compressible to engage the surrounding wall of the casing when set.

Figure 3C:
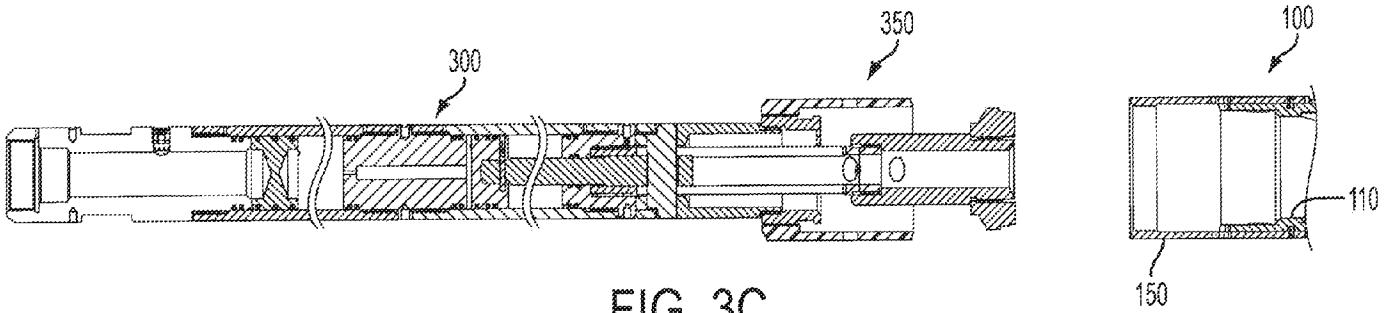
FIG. 3C shows a cross-section of setting equipment for the bridge plug.
Figure 4:
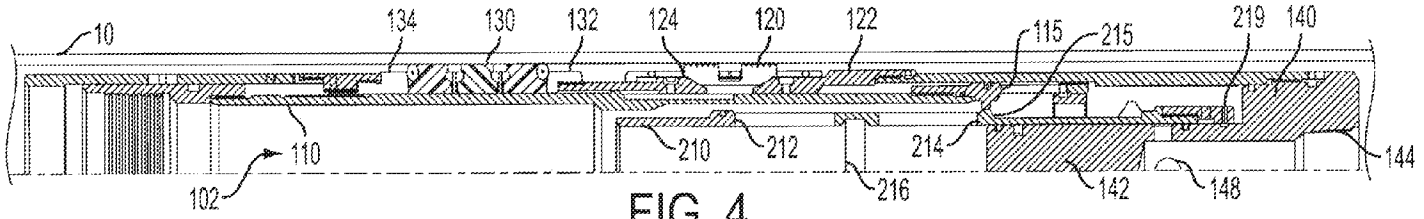
FIG. 4 partially shows the bridge plug when in a set condition within a borehole.

Setting the plug 100 involves running the bridge plug 100 in the casing to a desired setting depth using setting equipment (not shown), such as using a wireline pressure setting assembly and a wireline adapter kit or using tubing with a hydraulic setting tool and adapter kit. As one example, FIG. 3C shows setting equipment having a hydraulic setting tool 300 and adapter kit 350. The equipment is shown uncoupled relative to the end of the bridge plug 100 for reference.

When run downhole, the setting equipment manipulates the setting sleeve 150 and the mandrel 110 relative to one another. As best shown in FIG. 3A, the setting sleeve 150 is movable relative to the mandrel 110 and relative to a lower housing 160 coupled to the tailpiece 140. Manipulation of the setting sleeve 150 forces the cones 122/124 together to push the slips 120 outward toward a surrounding casing wall and forces the gage rings 132/134 together to compress the packing element 130 outward toward the surrounding casing wall. The plug 100 also includes lock rings, shear screws, and other conventional components used in setting of the plug 100 as commonly used in the art and not detailed here.

In contrast to conventional components, the bridge plug 100 has an internal valve assembly 200 designed to accept the retrieval tool 250 internally. The internal valve assembly 200 includes a releasing sleeve 210 disposed on a stem 142 of the tailpiece 140 and movable within the plug's mandrel 110. The retrieval tool 250 (FIG. 3B), which is described in more detail later, is used to clear debris and retrieve the plug 100 in FIG. 3A. Before coupling to the plug 100, for example, the retrieval tool 250 circulates fluid to clear debris. Then, the tool 250 positions in the releasing sleeve 210 to retrieve the plug 100 using procedures outlined below. Once the plug 100 is unset, the retrieval tool 250 can circulate fluid to clear debris from another downhole plug (if any). The retrieval tool 250 can be coupled to tubing or to another uphole bridge plug. In addition, the bridge plug 100 in FIG. 3A may also have such a retrieval tool 250 coupled to its tailpiece 140 so the plug 100 can be used to retrieve other like bridge plugs stacked downhole.

Turning to FIG. 3B, the retrieval tool 250 has a conduit 260, a slide locator 270, a collet 280, and a nozzle 290. When coupled to a tailpiece 140 of a bridge plug, the tool's passage 252 can communicate with ports 148 in the tailpiece's stem 142. As detailed below, these ports 148 communicate the plug's internal bore 102 with the conduit's bore 262 provided that the valve assembly 200 is in a condition to permit such communication.

As shown, the tool's conduit 260 can have two portions connected together by a coupler 262. Disposed on the conduit's lower portion 264, the slide locator 270 sealeably engages the conduit 260 with an O-ring seal 274 and uses set screws 272 to hold itself in position on the conduit 260. Also disposed on the conduit 260, the collet 280 has fingers 286 that extend down the conduit 260 relative to a shoulder 266 and a lock ledge 268 on the conduit's distal end. The nozzle 290 also fits on the conduit's distal end adjacent the lock ledge 268, and shear screws 294 temporarily affix the nozzle 290 thereto. Holes or ports 292 in the nozzle 290 communicate with the tool's internal passage 252 to communicate circulated fluid from the end of the tool 250 as discussed in more detail below. The nozzle 290 with its ports 292 helps clear debris when fluid is circulated through the tool 250. In addition, the nozzle 290 produces a washdown jet with the circulated fluid. This produced jet can cut or jet through hard debris bridges that may develop downhole after a frac operation or the like.

Figure 9:
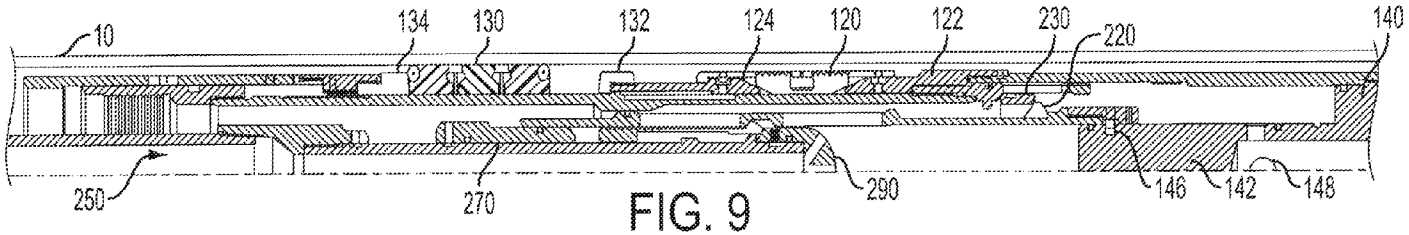
FIG. 9 partially shows the bridge plug locked in an extended condition.
Figure 10:
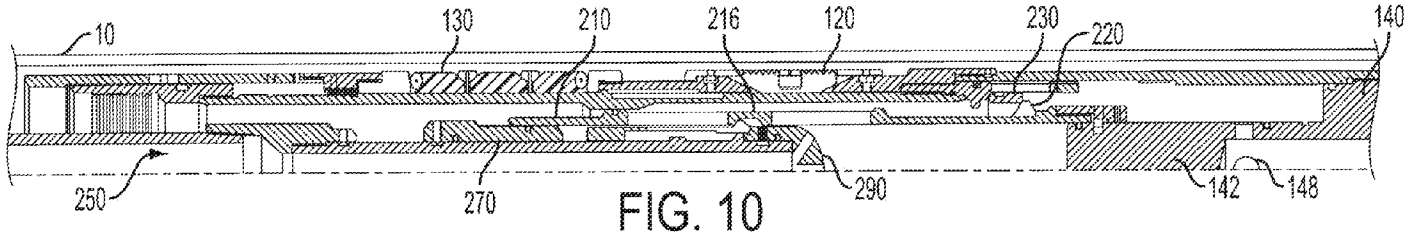
FIG. 10 partially shows the bridge plug in a condition when retrieved in tandem with one or more other bridge plugs.

Further details of the plug 100 and its operation are provided in FIGS. 4 through 10, which show a release sequence for the bridge plug 100 from a set condition (FIG. 4) to a released condition (FIG. 10). In the plug's set condition of FIG. 4, the slips 120 wedged by the cones 122/124 engage the surrounding casing 10 to hold the plug 100 in place, and the packing element 130 compressed by the gage rings 132/134 seals against the surrounding casing 10 to isolate the annulus. In this set condition, the bridge plug 100 isolates portions of the annulus on either side of the compressed packing element 130 and prevents fluid flow through the plug's internal passage 102. In this way, the plug 100 can be used for frac operations in which frac fluid having sand or other proppant is pumped downhole and the plug 100 prevents the frac fluid from passing further downhole to an isolated zone. (As an added advantage, the plug's components in this set condition are prevented from rotating, which can make milling of the plug 100 easier if needed when the plug 100 is stuck or the like.)

In the set condition, the releasing sleeve 210 has a lower, fixed position on the tailpiece's stem 142, and shear screws 219 hold the sleeve's lower end on the stem 142. Although circulated fluid can enter the through the top of the passage 102 and the top of the releasing sleeve 210 and its slots 212/214 to clear debris, O-ring seals on the outside of the stem 142 seal with the inside of the sleeve 210 and prevent fluid from passing through the stem's ports 148. Being blocked, the fluid is prevented from otherwise passing through the tailpiece's opening 144 into a retrieval tool (250) if coupled thereto. In addition to the seals, a rim 215 on the outside of the sleeve 210 aligns in a high tolerance fit with a rim 115 coupled to the inside of the mandrel 110. This interference fit prevents the sand or other proppant in the frac fluid from collecting in the plug's tailpiece 140, which could affect later operation.

Figure 5:
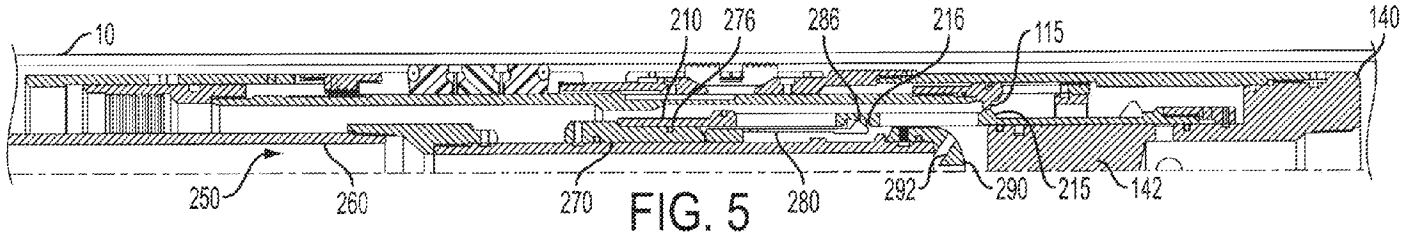
FIG. 5 partially shows the bridge plug with a retrieval tool initially positioned therein during a circulate and set down condition.

As shown in FIG. 5, a retrieval tool 250 on the tailpiece of an uphole plug (not shown) or on a retrieval string (not shown) initially positions in the plug's internal bore 102 during a circulate and set down stage. As can be seen in the steps outlined below, the retrieval tool 250 does not need to be rotated to release the bridge plug 100. Therefore, coiled or jointed tubing can be used to deploy the retrieval tool 250 downhole to the plug 100.

During set down, the retrieval tool 250 engages in the plug 100 so that the tool's conduit 260 disposes in the valve's sleeve 210 until the slide locator 270 engages the sleeve 210 as shown in FIG. 5. As the tool 250 inserts in the sleeve 210, the collet 280 slides along the conduit 260 with the collet's fingers 286 catching in the sleeve's lock groove 216. The outer seal 276 on the locator 270 sealably engages inside the mandrel 210.

All the while during set down of the tool 250, fluid is circulated through tool 250, passing down the conduit 260 and diverting out the nozzle's holes 292. While the retrieval tool 250 runs into the releasing sleeve 210, operators pump the fluid down the string and tool 250 and wash debris (e.g., sand) from bridge plug 100. The circulated fluid clears the debris retained in the bridge plug 100 from a previous frac operation so that the tool 250 can properly set down and engage in the sleeve 210.

Even though fluid is constantly circulated, however, the fixed sleeve 210 prevents the fluid from flowing out the plug's tailpiece 140. Moreover, the interface fit between the rim 115 and shoulder 215 prevents debris from collecting in the bottom of the tailpiece 140. Not only does the nozzle 290 help to clear debris that may have collected in the plug 100, the diversion of the fluid by the holes 292 as the tool 250 is moved downhole can also help cut through sand packs or the like that may have developed after a frac operation.

Figure 6:
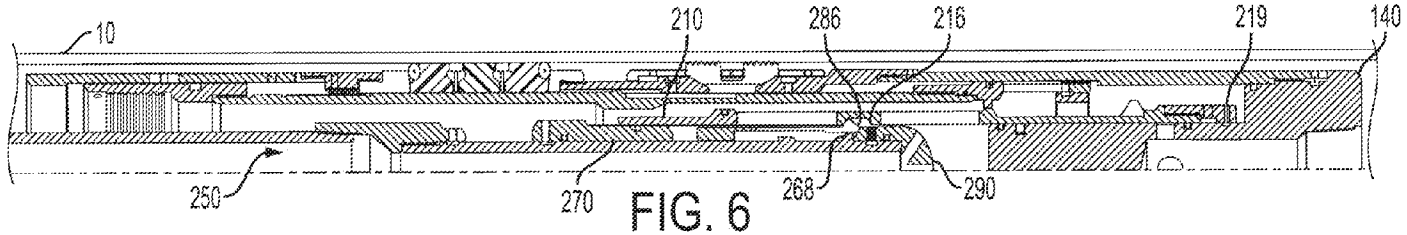
FIG. 6 partially shows the bridge plug while pulling up with the retrieval tool and circulating fluid.
Figure 7:
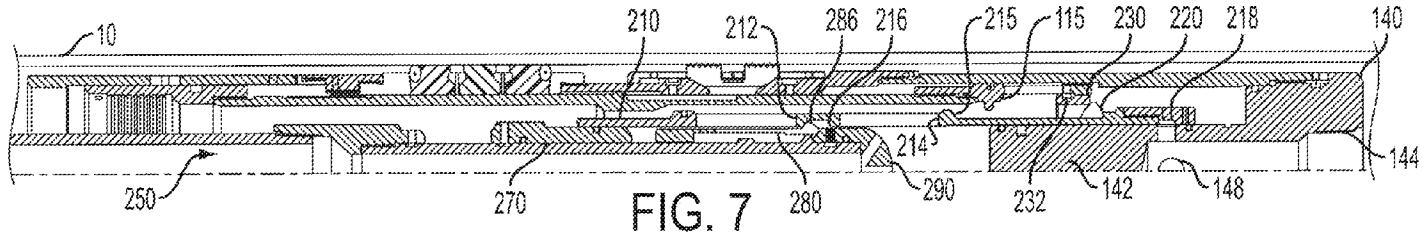
FIG. 7 partially shows the bridge plug while equalizing the plug and circulating fluid.
Figure 8:
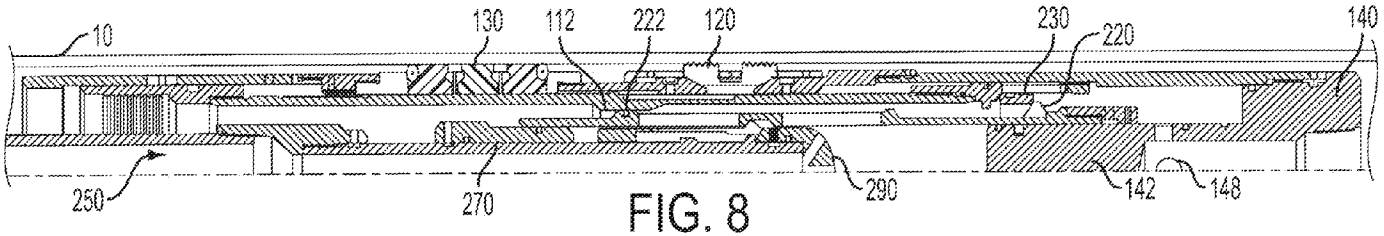
FIG. 8 partially shows the bridge plug in a released condition in which fluid pumps directly through the bottom of the plug.

As shown in FIG. 6, once the tool 250 is set down, operators pull up on the retrieval tool 250 while still circulating fluid through the tool 250 and plug 100. The locator 270 moves away from the releasing sleeve 210, but the collet's fingers 286 stay in the lock groove 216 until the lock ledge 268 fixes the fingers 286 therein. With this engagement, pulling tension on the retrieval tool 250 transfers to the sleeve 210 until the shear screws 219 release the sleeve 210 from the stem 142. As shown in FIG. 7, continued pulling moves the sleeve 210 up on the stem 142 until a snap ring cap 218 aligns with the stem ports 148 and a catch 220 engages a support ring 230. In addition, the shoulder 215 on the sleeve 210 misaligns from the stem 115, removing the interference fit previously isolating the lower portion of the plug 100.

Further pulling up on the retrieval tool 250 moves the sleeve 210 to a first equalizing position shown in FIG. 7. At this point, the bridge plug 100 equalizes fluid pressure above and below the plug 100. In one implementation, for example, the sleeve 210 will reach the first equalizing position after the retrieval tool 250 has moved the sleeve 210 about three inches. With the equalizing position reached, operators continually circulate fluid until the plug 100 is completely equalized. Fluid coming out of the nozzle 290 clears out the tailpiece 140, and the fluid and debris flows through the sleeve's slots 212/214 and up the inside of the mandrel 110.

After equalization, operators stop pumping fluid and pick up on the engaged retrieval tool 250 to release the plug 100 from the casing 10. In doing this, operators may move the plug 100 up five to ten feet in the casing 10. Pressure below the packing element 130 continues to equalize with pressure above the packing element 130 at this time. Further tension to a pre-set limit then releases the plug 100 as shown in stages of FIGS. 7, 8, 9, and 10.

As shown in FIG. 7, pulling up on the sleeve 210 forces its catch 220 to shear the pins 232 holding the support ring 230 to the mandrel 110. As then shown in FIG. 8, for example, pulling up on the retrieval tool 250 thereby lifts the sleeve 210 further up the stem 142 and likewise moves the catch 220 and ring 230 against a portion of the mandrel 110 (adjacent the ledge 115). Moving of the sleeve 210 opens up the tailpiece's ports 148, while an outside O-ring 222 on the sleeve 210 engages an internal throat 112 in the mandrel 110, essentially sealing the bottom of the plug's bore 102 from the top.

Eventually as shown in FIG. 9, pulling up on the retrieval tool 250 causes a snap ring 146 on the stem 142 to fit into a snap ring slot on the inside of the sleeve 210. This locks the sleeve 210 in position on the stem 142 during release. Moreover, pulling up on the retrieval tool 250 eventually releases the slips 120 and packing elements 130 from the casing 10 as shown in FIGS. 9 and 10 by pulling up the mandrel 110 relative to the tailpiece 140. In particular, the moving sleeve 210 moves the mandrel 110 via the engagement of the catch 220 with the support ring 230, and this moves the gage rings 132/134 apart (uncompressing packing element 130) and moves the cones 122/124 apart (unwedging slips 120).

As the plug 100 is lifted to confirm release, the plug 100 therefore becomes locked into an extended released condition via the snap ring 146. After releasing the plug 100 and moving it up five to ten feet in the wellbore, operators then move the plug 100 back down to its original setting depth and kick the pumps back on to circulate fluid. At this point, the plug 100 and its retrieval tool 250 can be tripped out of the wellbore, or they can be moved downhole to engage another lower bridge plug (not shown) in the wellbore. For example, the plug's retrieval tool (250) coupled at the bottom of the plug 100 can be used to retrieve the next lower plug down the wellbore, which is configured identically.

In its extended condition, the plug 100 will not re-set or lodge in the casing 10 when moved downhole. In this way, the released plug 110 can be moved downhole to retrieve lower plugs without the plug 100 resetting, and any number of plugs 100 can be retrieved in one trip in the borehole using coiled or jointed tubing. Accordingly, the bridge plug 100 in the released condition shown in FIG. 10 can be used to retrieve one or more downhole plugs in tandem. Yet, fluid pumped through the retrieval tool 250 and the plug 100 is not lost to the annulus because all of the circulated fluid circulates through the plug's tailpiece 140 and coupled retrieval tool (250).

In particular, the circulated fluid pumped down the retrieval tool 250 flows out the nozzle 290, flushes out the tailpiece's ports 148, and flows directly to the other retrieval tool (not shown) connected to the plug's tailpiece 140. The arrangement of the plug 100 and retrieval tool 250 allows operators to circulate fluid in either direction prior to and during equalization and after release of the plug 100. For example, the fluid circulation can use conventional circulation as discussed above, or a reverse circulation can be used. Either way, the path of the circulated fluid is sealed after the plug 100 is released so that fluid loss is greatly minimized regardless of the number of plugs 100 being retrieved.

Sometimes during operations, operators may need to release the retrieval string from the bridge plug 100. If the plug 100 fails to release properly, for example, then the retrieval tool 250 can be released in an emergency operation by using a pre-set straight pull to shear the retrieval tool 250 free in the event that the plug 100 cannot be released or retrieved for some reason.

Figure 11:
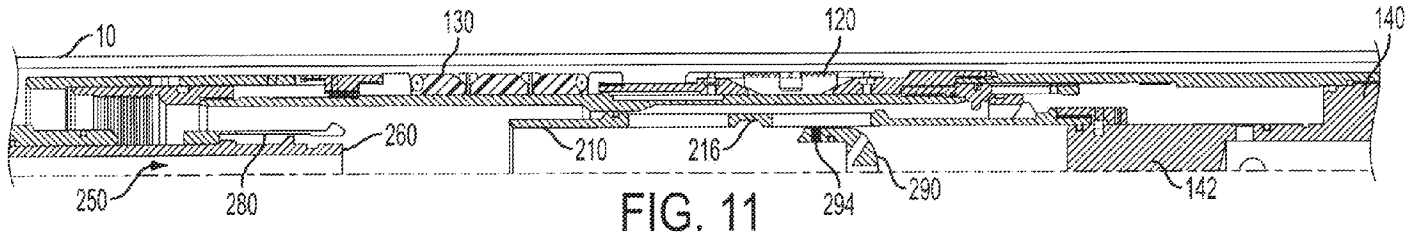
FIG. 11 partially shows the bridge plug during an emergency release of the retrieval tool from the plug.

As shown more particularly in FIG. 11, the bridge plug 100 can be released during an emergency if the plug 100 becomes stuck downhole or the like. By jarring up hard on the retrieval tool 250, the tool's conduit 260 held to the nozzle 290 by shear screws 294 can break free of the sleeve 210 so the retrieval tool 250 can be removed from the stuck plug 100. This is a safety shear, which will enable the retrieval tool 250 to be sheared free of the bridge plug 100 if the plug 100 will not release. Other remedial procedures can then be used to deal with the stuck plug 100.

Figure 12:
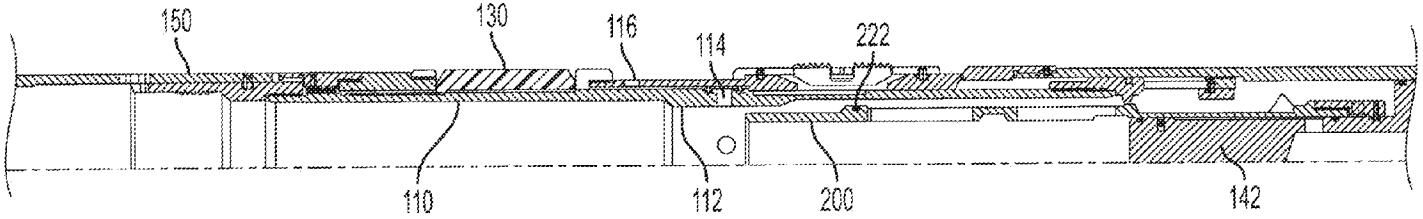
FIG. 12 partially shows the bridge plug having additional ports for relieving a surge of circulated fluid around the packing element.

Another example of the bridge plug 100 illustrated in FIG. 12 has the same components as before so that the same reference numerals are reused. This plug 100, however, has additional fluid bypass ports 114/116. The mandrel 110 defines one port 114 near its internal throat 112, while portion of the upper slip 124 defines the other port 116 outside the mandrel 110. The mandrel's port 114 preferably has seals to sealably engage the inside of the upper slip 124.

As noted previously but not shown in FIG. 12, the internal valve assembly 200 is moved upward in the mandrel 110 when the assembly 200 is pulled into its fully released position (best represented in FIG. 10). In the released position, the valve's seal 222 engages the mandrel's internal throat 112. Consequently, fluid circulated through the inserted retrieval tool (250) can pass through the valve assembly 200 and out the plug's tailpiece 142 as described previously.

While fluid is circulated, however, some of the circulated fluid can surge along the outside of the plug 100 and can go around the released packing element 130. If this occurs, the surging fluid may cause the packing element 130 to swell and possibly re-seal against the surrounding casing. The ports 114/116 on the plug 100 in FIG. 12 help to prevent this tendency. When the assembly 200 is pulled into its fully released position, the mandrel's port 114 sealably aligns with the outside port 116 so circulated fluid on the outside of the plug 100 below the packing element 130 can bypass through the inside of the plug 100. As a result, any surge of circulated fluid that may develop around the outside of the plug 100 can be relieved through the plug 100, thereby reducing the possible swelling of the packing element 130.

The following reference numerals used in the present disclosure are listed here with corresponding element names.

| Numeral | Element Name |
|---|---|
| 100 | Bridge Plug |
| 102 | Plug's Internal Bore |
| 110 | Mandrel |
| 112 | Throat |
| 114 | Port in Mandrel |

-continued

| Numeral | Element Name |
|---|---|
| 116 | Port in Upper Cone |
| 120 | Slip |
| 122 | Lower Cone |
| 124 | Upper Cone |
| 130 | Packing element |
| 132 | Lower Gage Ring |
| 134 | Upper Gage Ring |
| 140 | Tailpiece |
| 142 | Stem |
| 144 | Lower Opening |
| 146 | Snap Ring |
| 148 | Port |
| 150 | Setting Sleeve |
| 160 | Lower Housing |
| 200 | Internal Valve Assembly |
| 210 | Releasing Sleeve |
| 212 | Lower Slots |
| 214 | Upper Slots |
| 216 | Retaining groove |
| 218 | Snap Ring Cap |
| 219 | Set Screw |
| 220 | Catch |
| 222 | O-ring Seal |
| 230 | Support Ring |
| 232 | Shear Pins |
| 250 | Retrieval tool |
| 252 | Passage |
| 260 | Conduit |
| 262 | Crossover coupling |
| 264 | Lower conduit |
| 266 | Shoulder |
| 268 | Lock Ledge |
| 270 | Slide Locator |
| 272 | Shear Screw |
| 274 | Seal |
| 276 | Seal |
| 280 | Slide Release Collet |
| 286 | Fingers |
| 290 | Nozzle |
| 292 | Ports |
| 294 | Shear Screw |

The foregoing description of preferred and other embodiments is not intended to limit or restrict the scope or applicability of the inventive concepts conceived of by the Applicants. Various modifications can be made without departing from the teachings of the present disclosure. For example, the size of the equalizing ports can be adjustable to suit expected pressure differentials. The shear values for equalizing and releasing the plug 100 can be adjusted to suit a particular well condition.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A bridge plug retrieval method, comprising:

running a string downhole in a wellbore;

removing debris from an internal passage of a first bridge plug set downhole by circulating fluid from a first retrieval tool on the string relative to the first bridge plug;

engaging the first retrieval tool on the string with a first valve inside the first bridge plug by inserting the first retrieval tool inside the internal passage of the first bridge plug;

moving the first valve in the first bridge plug from a closed condition to an open condition by pulling up on the first valve with the first retrieval tool;

releasing the first bridge plug from the wellbore through the movement of the first valve toward the open condition; and circulating fluid through the first bridge plug by communicating the fluid from the string, out the first retrieval tool, and through the first valve in the open condition.

2. The method of claim 1, wherein the string comprises coiled or jointed tubing.

3. The method of claim 1, wherein releasing the first bridge plug from the wellbore comprises disengaging a slip disposed on the first bridge plug from a surrounding wall in the wellbore.

4. The method of claim 3, wherein disengaging the slip disposed on the first bridge plug from the surrounding wall in the wellbore comprises moving a first cone disposed on the first bridge plug away from a second cone disposed on the first bridge plug through the movement of the first valve toward the open condition.

5. The method of claim 1, wherein releasing the first bridge plug from the wellbore comprises disengaging a packing element disposed on the first bridge plug from a surrounding wall in the wellbore.

6. The method of claim 5, wherein disengaging the packing element disposed on the first bridge plug from the surrounding wall in the wellbore comprises moving a first gage ring disposed on the first bridge plug away from a second gage ring disposed on the first bridge plug through the movement of the first valve toward the open condition.

7. The method of claim 1, further comprising:

equalizing pressure in the wellbore on both sides of the first bridge plug by moving the first valve to an intermediate condition before the open condition.

8. The method of claim 1, further comprising:

moving the released first bridge plug downhole with the string; and removing debris from a second bridge plug set downhole by circulating fluid through the string and the first valve in the opened condition.

9. The method of claim 8, further comprising:

engaging a second retrieval tool disposed on the first bridge plug with a second valve inside the second bridge plug; and moving the second valve in the second bridge plug from a closed condition to an open condition by pulling up on the second valve with the second retrieval tool.

10. The method of claim 9, further comprising:

releasing the second bridge plug from the wellbore through the movement of the second valve toward the open condition; and circulating fluid through the first and second bridge plugs by communicating the fluid from the string through the first and second valves in the open condition.

11. The method of claim 1, wherein moving the first valve in the first bridge plug from the closed condition to the opened condition comprises moving a valve element disposed in the internal passage of a first portion of the first bridge plug relative to at least one port in a second portion of the first bridge plug.

12. The method of claim 11, wherein moving the valve element comprises moving the valve element from a first condition to a second condition, the valve element in the first condition preventing fluid flow between the internal passage and the at least one port, the valve element in the second condition allowing fluid communication between an internal bore of the valve element and the at least one port.

13. The method of claim 12, wherein releasing the first bridge plug from the wellbore through the movement of the first valve toward the open condition comprises moving the first portion of the first bridge plug relative to the second portion of the first bridge plug with the movement of the valve element to the second condition.

14. The method of claim 12, wherein moving the valve element to the second condition to allow fluid communication between the internal bore of the valve element and the at least one port comprises sealably engaging an external seal on the valve element in the second condition with the internal passage of the first bridge plug.

15. The method of claim 12, wherein moving the valve element from the first condition to the second condition comprises:

moving the valve element to an intermediate condition between the first and second conditions, allowing fluid communication between the internal passage of the first bridge plug and the at least one port of the first bridge plug, and equalizing fluid pressure on both sides of an engagement assembly of the first bridge plug engaged with the surrounding wall.

16. The method of claim 11, wherein moving the first valve in the first bridge plug from the closed condition to the opened condition comprises preventing passage of debris by aligning a shoulder disposed about the valve element with a ledge disposed about the internal passage of the first bridge plug.

17. The method of claim 11, wherein moving the valve element disposed in the internal passage of the first bridge plug relative to the at least one port in the first bridge plug comprises engaging a collet disposed on the first retrieval tool in a profile defined in an internal bore of the valve element.

18. The method of claim 17, wherein engaging the collet in the profile comprises releasably supporting the collet with a breakable connection of a nozzle on the first retrieval tool.

19. The method of claim 11, wherein circulating fluid through the first bridge plug comprises conducting the fluid through a conduit of the first retrieval tool sealably engaged in an internal bore of the valve element.

20. The method of claim 1, wherein removing the debris from the first bridge plug by circulating fluid from the string relative to the first bridge plug comprises jetting fluid conducted from a nozzle on the first retrieval tool.

21. A bridge plug retrieval method, comprising:

running a string downhole in a wellbore;

removing debris from a first bridge plug set downhole by circulating fluid from the string relative to the first bridge plug;

engaging a first retrieval tool on the string with a first valve inside the first bridge plug;

moving the first valve in the first bridge plug from a closed condition to an open condition by pulling up on the first valve with the first retrieval tool;

releasing the first bridge plug from the wellbore through the movement of the first valve toward the open condition;

circulating fluid through the first bridge plug by communicating the fluid from the string through the first valve in the open condition;

moving the released first bridge plug downhole with the string; and removing debris from a second bridge plug set downhole by circulating fluid through the string and the first valve in the opened condition.

22. The method of claim 21, further comprising:

engaging a second retrieval tool disposed on the first bridge plug with a second valve inside the second bridge plug; and moving the second valve in the second bridge plug from a closed condition to an open condition by pulling up on the second valve with the second retrieval tool.

23. The method of claim 22, further comprising:

releasing the second bridge plug from the wellbore through the movement of the second valve toward the open condition; and circulating fluid through the first and second bridge plugs by communicating the fluid from the string through the first and second valves in the open condition.

24. The method of claim 23, further comprising repeating the acts of moving the released bridge plugs downhole with the string, removing debris from another bridge plug set downhole, engaging another retrieval tool with another valve, and moving the other valve to an open condition.

25. The method of claim 21, wherein moving the first valve in the first bridge plug from the closed condition to the opened condition comprises moving a valve element disposed in the internal passage of a first portion of the first bridge plug relative to at least one port in a second portion of the first bridge plug.

26. The method of claim 25, wherein moving the valve element comprises moving the valve element from a first condition to a second condition, the valve element in the first condition preventing fluid flow between the internal passage and the at least one port, the valve element in the second condition allowing fluid communication between an internal bore of the valve element and the at least one port and sealably engaging an external seal on the valve element with the internal passage of the first bridge plug.

27. The method of claim 25, wherein moving the valve element disposed in the internal passage of the first bridge plug relative to the at least one port in the first bridge plug comprises engaging a collet disposed on the first retrieval tool in a profile defined in an internal bore of the valve element.

28. The method of claim 27, wherein engaging the collet in the profile comprises releasably supporting the collet with a breakable connection of a nozzle on the first retrieval tool.

29. The method of claim 25, wherein circulating fluid through the first bridge plug comprises conducting the fluid through a conduit of the first retrieval tool sealably engaged in an internal bore of the valve element.

30. A bridge plug retrieval method, comprising:

running a string downhole in a wellbore;

removing debris from a first bridge plug set downhole by circulating fluid from the string relative to the first bridge plug;

engaging a first retrieval tool on the string with a first valve inside the first bridge plug;

moving a valve element of the first valve disposed in an internal passage of a first portion of the first bridge plug from a first, closed condition to a second, open condition relative to at least one port in a second portion of the first bridge plug by pulling up on the first valve with the first retrieval tool and sealably engaging an external seal on the valve element in the second condition with the internal passage of the first bridge plug, the valve element in the first condition preventing fluid flow between the internal passage and the at least one port, the valve element in the second condition allowing fluid communication between an internal bore of the valve element and the at least one port;

releasing the first bridge plug from the wellbore through the movement of the first valve toward the open condition; and circulating fluid through the first bridge plug by communicating the fluid from the string through the first valve in the open condition.

31. The method of claim 30, wherein moving the valve element disposed in the internal passage of the first bridge plug relative to the at least one port in the first bridge plug comprises engaging a collet disposed on the first retrieval tool in a profile defined in an internal bore of the valve element.

32. The method of claim 31, wherein engaging the collet in the profile comprises releasably supporting the collet with a breakable connection of a nozzle on the first retrieval tool.

33. The method of claim 30, wherein circulating fluid through the first bridge plug comprises conducting the fluid through a conduit of the first retrieval tool sealably engaged in an internal bore of the valve element.

34. A bridge plug retrieval method, comprising:

running a string downhole in a wellbore;

removing debris from a first bridge plug set downhole by circulating fluid from the string relative to the first bridge plug;

engaging a first retrieval tool on the string with a first valve inside the first bridge plug;

moving a valve element of the first valve disposed in an internal passage of a first portion of the first bridge plug from a closed condition to an open condition relative to at least one port in a second portion of the first bridge plug by engaging a collet disposed on the first retrieval tool in a profile defined in an internal bore of the valve element and pulling up on the first valve with the first retrieval tool;

releasing the first bridge plug from the wellbore through the movement of the first valve toward the open condition; and circulating fluid through the first bridge plug by communicating the fluid from the string through the first valve in the open condition.

35. The method of claim 34, wherein engaging the collet in the profile comprises releasably supporting the collet with a breakable connection of a nozzle on the first retrieval tool.

36. The method of claim 34, wherein circulating fluid through the first bridge plug comprises conducting the fluid through a conduit of the first retrieval tool sealably engaged in an internal bore of the valve element.

37. A bridge plug retrieval method, comprising:

running a string downhole in a wellbore;

removing debris from a first bridge plug set downhole by circulating fluid from the string relative to the first bridge plug;

engaging a first retrieval tool on the string with a first valve inside the first bridge plug;

moving a valve element of the first valve disposed in an internal passage of a first portion of the first bridge plug from a closed condition to an open condition relative to at least one port in a second portion of the first bridge plug by pulling up on the first valve with the first retrieval tool;

releasing the first bridge plug from the wellbore through the movement of the first valve toward the open condition; and circulating fluid through the first bridge plug by communicating the fluid from the string through the first valve in the open condition and conducting the fluid through a conduit of the first retrieval tool sealably engaged in an internal bore of the valve element.

* * * * *